United States Patent [19]

Pai et al.

[11] Patent Number: 4,959,287

[45] Date of Patent: Sep. 25, 1990

[54] XERORADIOGRAPHIC IMAGING MEMBER

[75] Inventors: Damodar M. Pai, Fairport; Philip G. Perry, Webster; Kenneth J. Pheilshifter, Rochester, all of N.Y.

[73] Assignee: Xerox Corporation, Stamford, Conn.

[21] Appl. No.: 413,402

[22] Filed: Sep. 27, 1989

[51] Int. Cl.[5] ..... G03G 5/047; G03G 13/22

[52] U.S. Cl. ..... 430/59; 430/58; 430/31; 430/120; 430/126; 250/315.3

[58] Field of Search ..... 430/58, 59, 31, 126

[56] References Cited

U.S. PATENT DOCUMENTS

| | | | |
|---|---|---|---|
| 4,281,054 | 7/1981 | Horgan et al. | 430/59 |
| 4,442,192 | 4/1984 | Pai | 430/59 |
| 4,515,882 | 5/1985 | Mammino et al. | 430/58 |
| 4,582,772 | 4/1986 | Teuscher et al. | 430/58 |
| 4,770,965 | 9/1988 | Fender et al. | 430/66 |
| 4,874,682 | 10/1989 | Scott et al. | 430/58 X |

*Primary Examiner*—Roland E. Martin

*Attorney, Agent, or Firm*—Peter H.g32 Kondo

[57] ABSTRACT

A xeroradiographic imaging member containing a substrate having an electrically conductive surface, an electroradiographic insulating layer selected from the group consisting of selenium and selenium alloys, and an overcoating layer containing nigrosene, a charge transport compound and a copolyester resin represented by the following formula:

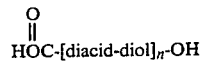

wherein the diacid is selected from the group consisting of terephthalic acid, isophthalic acid, and mixtures thereof, the diol comprises ethylene glycol, the mole ratio of the diacid to the diol is about 1:1, n is a number between about 175 and about 350 and the $T_g$ of the copolyester resin is between about 50° C. about 80° C.

19 Claims, No Drawings

XERORADIOGRAPHIC IMAGING MEMBER

This invention relates in general to electroradiographic imaging members and more specifically, to overcoated electroradiographic imaging members and processes for using the members.

In the art of electroradiography, an electroradiographic plate comprising a photoconductive insulating layer on a conductive layer is imaged by first uniformly electrostatically charging the imaging surface of the photoconductive insulating layer. The plate is then exposed to a pattern of activating X-ray radiation, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

In conventional xerography, xerographic plates have a thickness of about 60 micrometers and the holes and electrons generated when the photoconductive layer is struck by activating radiation can move through the thickness of the plate without difficulty. In xeroradiography, it is also important that the amount of X-ray radiation be minimized to avoid adverse effects on a patient. Low dosages of X-ray radiation require a thicker xeroradiographic plate to ensure adequate absorption of the X-ray to photogenerate holes and electrons. However, thicker plates having a thickness of about 90 micrometers or more are too thick for complete traversal by holes and electrons created during exposure. Thus, these charges are trapped and fatigue and ghosting can occur. Ghosting is the appearance of images carried over from images on previous imaging cycles. In addition, a wide range of density in the final image is desirable to enable a physician to distinguish different types of tissue and tissue abnormalities in the xeroradiographic image. Thus, powder cloud development is employed in xeroradiography because it is so sensitive that it is able to develop a voltage difference as little as about 5 volts in image potentials. Conventional xerographic processes such as cascade and magnetic brush development systems are incapable of developing a 5 volt difference. Because of the high sensitivity of powder cloud development, defects such as fatigue and ghosting are greatly magnified when powder cloud is utilized for development. The exceptionally sensitive powder cloud development system readily develops defects in the xeroradiographic imaging member and amplifies nuances that would normally not be observable with conventional two component developer systems. Such defects can obscure the true image in the final print and cause a physician to misinterpret what he or she is observing.

To minimize ghosting and fatigue caused by hole and electron trapping in thick selenium alloy films employed in xeroradiography, the plates are heated between imaging cycles. The thick xeroradiographic plates are usually overcoated with a protective layer to protect the selenium or selenium alloy layer from environmental contamination, wear and abrasion which would lead to surface crystallization, especially during the heating cycle, and ultimately a loss in ability to retain surface charge. The overcoating must be sufficiently conductive to leak electrostatic charge during cycling to prevent residual build up. Residual build up causes ghosting and/or background density build up in subsequent cycles. However, an overcoating should not be so conductive that charge leakage prevents achievement of adequate image resolution. Moreover, the overcoating component should form a smooth, uniform film and be easy to apply. In addition, the overcoating should not cause fatigue and white spots. Thus, the performance requirements for a xeroradiographic plate overcoating are exceptionally stringent.

One common overcoating comprises polyvinylidenefluoride (F310 Saran, available from Dow Chemical Company), polyester (PE200, available from Goodyear Tire & Rubber Company), polyurethane and nigrosine dye. Although excellent images can be made on this plate, the yield for this overcoated plate during manufacture is low and the total life of the plate during use for imaging can be undesirably short due to print deletion spots that form when the plate is cycled. Print deletion spots result in white spots in the image areas of the final toner image. Fatigue white spots have caused high yield loses during manufacturing. Fatigue white spots are not apparent until the second print is made. In other words, no white spots normally occur on the first print. The current photoreceptor present a high yield loss before the plate is imaged ($t=0$, the time of manufacture). Moreover, the life of the prior art xeroradiographic plates during image cycling is relatively low.

It is believed that white spots are caused by crystallites forming at the interface between the conductive substrate and selenium photoconductive layer. Holes from the crystallites at the interface travel toward the imaging surface of the xeroradiographic plate during the pretransfer charging step when a negative charge is applied to the xeroradiographic plate. These holes are trapped at the interface between the selenium photoconductive layer and the overcoating layer. During the next uniform positive charging step, the holes travel back to the conductive layer and discharge the xeroradiographic plate which ultimately results in white spots in the final image. Heating the xeroradiographic plates to a temperature about 46° C. for about a half hour helps minimize fatigue and ghosting and eliminate trapped charges. Unfortunately, such heating contributes to the crystallization of the selenium alloy layer thereby adversely affecting the life of the plate. Further, overcoating components such as polyurethane are highly humidity sensitive whereas an overcoating for xeroradiographic plates should be highly insensitive to a wide humidity range.

Thus, there is a continuing need for a xeroradiographic imaging member having an improved resistance to white spots, improved resolution at higher humidity, minimal ghosting and the like.

INFORMATION DISCLOSURE STATEMENT

U.S. Pat. No. 4,770,965 to Fender et al, issued Sept. 13, 1988—An electrophotographic imaging member is disclosed comprising a conductive substrate and an alloy layer comprising selenium doped with arsenic and chlorine having a thickness of between about 100 micrometers and about 400 micrometers, the alloy layer comprising between about 0.3 percent and about 2 percent by weight arsenic at the surface of the alloy layer facing away from the conductive substrate and comprising crystalline selenium having a thickness of from about 0.01 micrometer to about 1 micrometer contiguous to the conductive substrate. The alloy selenium layer is coated with-a thin protective overcoating layer on the alloy layer, the overcoating layer comprising nigrosine, and other components such as a polyester resin.

U.S. Pat. No. 4,515,882 to Mammino et al., issued May 7, 1985—An electrophotographic imaging member is disclosed comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields. Numerous kinds of charge transport molecules are specified including aromatic diamines.

U.S. Pat. No. 4,582,772 to Teuscher et al., issued Apr. 15, 1986—A layered photoconductive imaging devices are disclosed comprising a substrate, a semi-conductive layer, a dielectric layer, a photogeneration layer, and a top layer comprising materials capable of transporting charge dispersed in a resinous binder. A charge carrier transport layer may comprise certain diamines dispersed in a suitable resinous matrix.

U.S. Pat. No. 4,442,192 to Pai, issued Apr. 10, 1984—A photoresponsive device is disclosed having an overcoating layer 28, containing an electron donating material dispersed in a resinous binder 29. Materials capable of donating electrons and which are useful in layer 28 are disclosed at column 5, line 47-column 6, line 20.

U.S. Pat. No. 4,281,054 to Horgan et al., issued Jul. 28, 1981—An overcoated photoreceptor is disclosed. A transport layer is also disclosed which comprises diamine molecules and an electrically inactive binder polymeric material.

SUMMARY OF THE INVENTION

It is, therefore, an object of the present invention to provide an improved overcoated xeroradiographic imaging member which overcomes the above-noted disadvantages.

It is yet another object of the present invention to provide an improved overcoated xeroradiographic imaging member which prevents fatigue spots from appearing in images after the formation of the first xeroradiographic image.

It is still another object of the present invention to provide an improved overcoated xeroradiographic imaging member that exhibits greater insensitivity to changes in humidity.

It is another object of the present invention to provide an improved overcoated xeroradiographic imaging member that exhibits sharper images as perceived by physicians.

It is yet another object of the present invention to provide an improved overcoated xeroradiographic imaging member having greatly extended cycling life.

It is still another object of the present invention to provide an improved overcoated xeroradiographic imaging member that forms higher resolution and sharper images.

It is another object of the present invention to provide an improved overcoated xeroradiographic imaging member reduces the number of rejected plates due to white spots at t=0, the time of manufacture.

The foregoing objects and others are accomplished in accordance with this invention by providing a xeroradiographic imaging member comprising a substrate having an electrically conductive surface, an electroradiographic insulating layer selected from the group consisting of selenium and selenium alloys, and an overcoating layer comprising nigrosene, a charge transport compound and a copolyester resin represented by the following formula:

$$\mathrm{HO}\overset{\overset{\mathrm{O}}{\|}}{\mathrm{C}}\text{-[diacid-diol]}_n\text{-OH}$$

wherein the diacid is selected from the group consisting of terephthalic acid, isophthalic acid, and mixtures thereof, the diol comprises ethylene glycol, the mole ratio of the diacid to the diol is about 1:1, n is a number between about 175 and about 350 and the $T_g$ of the copolyester resin is between about 50° C. about 80° C.

Xeroradiographic imaging members are well known in the art. Typical xeroradiographic imaging members include, for example, a substrate having an electrically conductive surface, an electroradiographic insulating layer of selenium or selenium alloy, and, in some embodiments, an overcoating layer.

The xeroradiographic imaging members of this invention may be prepared by any suitable technique. Typically, a substrate is provided having an electrically conductive surface. At least one photoconductive layer sensitive to X-ray radiation is then applied by vacuum deposition techniques to the electrically conductive surface. A protective overcoating layer of this invention is then applied to the photoconductive layer.

The substrate may be an opaque metal such as aluminum and may comprise numerous suitable materials having the required mechanical properties and an electrically conductive surface. The entire substrate may comprise the same material as that in the electrically conductive surface or the electrically conductive surface may merely be a coating on the substrate. Any suitable electrically conductive material may be employed. Typical electrically conductive materials include, for example, aluminum, titanium, nickel, chromium, brass, copper, zinc, silver, tin and the like. The conductive layer may vary in thickness over substantially wide ranges depending on the desired use of the electrophotoconductive member. Accordingly, the conductive layer may generally range in thickness from about 50 Angstrom units with the upper limit being determined by ecconomic reasons. The substrate may comprise any other conventional material including organic and inorganic materials. Typical substrate materials include insulating non-conducting materials such as various resins known for this purpose including polyesters, polycarbonates, polyamides, polyurethanes, and the like. The coated or uncoated substrate having an electrically conductive surface may have any number of configurations such as, for example, a plate, a cylindrical drum, a scroll, and the like.

The outer surface of metallic supporting substrates adjacent to the photoconductive layer normally comprise a metal oxide such as aluminum oxide, nickel oxide, titanium oxide, and the like. An aluminum substrate with an insulating layer of aluminum oxide having a thickness of between about 10 Angstroms and about 1,000 Angstroms is preferred to provide an electron injection barrier layer and to thereby minimize electrical defects in the selenium coating. Although an oxide of aluminum naturally forms on aluminum exposed to the atmosphere, the oxide layer may contain imperfections. Imperfections are minimized by careful cleaning and controlled oxidation.

Any suitable cleaning material capable of providing a defect-free photoreceptor interface may be employed. Typical substrate cleaning compositions include Oakite NSS cleaner (available from Oakite Products, Inc., New Jersey), water, sodium carbonate, trisodium phosphate caustic bath, nitric acid bath and the like, followed by a deionized water rinse, nitric acid dip at 93° C. (200° F.) followed by a deionized water rinse, and the like. When caustic or acid baths are employed, the surface of the substrate is preferably rinsed with deionized water. Thus, for example, the substrate may be treated to a nitric acid dip followed by a deionized water rinse at about 93° C. (200° F.). Further cleaning and oxidation of the substrate may be accomplished by glow discharge treatment of the substrate in the vacuum coater. Formation of the aluminum oxide layer can be closely monitored and controlled by regulation of a coater bleed gas flow rate with a precision flow gauge and valve. Pressure should be maintained between about 10 and about 100 micrometers of mercury. The substrate temperature should be less than about 115° C. (240° F.) and flow rate should be sufficient to maintain a high oxygen content atmosphere (about 21 percent for air).

In some cases, intermediate adhesive layers between the metal oxide surface and subsequently applied photoconductive layers may be desirable to improve adhesion. If such adhesive layers are utilized, they preferably have a dry thickness between about 0.1 micrometer to about 5 micrometers. Typical adhesive layers include et. al. film-forming polymers such as polyester, polyvinylbutyral, polyvinylpyrolidone, polyurethane, polymethylmethacrylate, and the like and mixtures thereof.

Any suitable photoconductive selenium or selenium alloy layer may be employed in the xeroradiographic imaging member of this invention. Typical selenium and selenium alloys include selenium arsenic alloys, selenium alloys doped with halogen, and the like. Typical starting alloy compositions (alloy prior to deposition) of selenium and arsenic contain up to about 10 percent arsenic based on the total weight of the alloy layer and up to about 50 parts per million chlorine. Preferably, the starting alloy is doped with between about 5 to about 25 parts per million by weight chlorine. A xeroradiographic selenium-arsenic alloy layer can, for example, be prepared from a starting alloy composition preferably comprising between about 0.05 percent by weight and about 2 percent by weight arsenic and up to about 25 parts per million by weight of halogen with the remainder being selenium. The expression "selenium-arsenic alloy" is intended to include halogen doped alloys as well as alloys not doped with halogen. Optimum X-ray sensitivity, X-ray absorption and maximum bi-polar carrier transport efficiency, are achieved with starting selenium-arsenic alloys containing between about 0.2 percent and about 0.5 percent by weight arsenic and between about 5 to about 25 parts per million by weight chlorine with the remainder being selenium. The preferred halogen is chlorine. Concentrations of arsenic in the starting alloy exceeding about 2 percent by weight lead to excessive hole trapping and surface deformation during thermal relaxation while concentrations of arsenic in the starting alloy less than about 0.05 percent by weight result in surface crystallization. As the chlorine content rises above about 25 parts per million by weight chlorine, the photoreceptor begins to exhibit high electron trapping and dark decay. The selenium-arsenic alloy photoconductive layer can be prepared by thermal blending of the selenium-arsenic alloy shot and chlorine doped selenium to obtain the desired dopant levels. The selenium shot is then treated in a Munsen blender to induce crystallinity and allowed to age under applied heat. Excellent results are achieved when the starting selenium alloy comprises about one third percent arsenic, about 10 parts per million chlorine and the remainder selenium. If desired, the selenium electroradiographic layer may comprise pure amorphous selenium.

Satisfactory results may be achieved with a photoconductive layer having a thickness between about 60 micrometers and 500 micrometers. When the thickness falls below about 60 micrometers, the X-ray dosage required to discharge the photoconductive layer reaches unacceptable levels and tend to exhibit photon shot noise from limited X-ray absorption. Photoconductive layer thicknesses exceeding about 500 micrometer tend to have fatigue and ghosting associated with unacceptable levels of hole and electron trapping and exceeding defect levels. Preferably, the photoconductive layer thickness is between about 100 micrometers and about 400 micrometers. Optimum results are achieved with alloy layers having a thickness between about 150 micrometers and about 300 micrometers.

The selenium-arsenic alloy may be at least partially crystallized using surface abrasion followed by thermal preconditioning treatment, and then placing the selenium alloy in shot form in a crucible in a vacuum coater and heating to between about 93° C. (200° F.) and about 177° C. (350° F.) for between about 20 minutes and about one hour to increase crystallinity and avoid reticulation. Preferably, the selenium-arsenic alloy material in shot form is heated until from about 2 percent to about 90 percent by weight of the selenium in the alloy is crystallized. The selenium-arsenic alloy material shot may be crystallized completely prior to vacuum deposition to ensure that a uniform starting point is employed. However, if desired, a completely amorphous alloy may used as the starting material for vacuum deposition.

Any suitable vacuum deposition technique may be employed to prepare the selenium or selenium alloy xeroradiographic layer. A well known technique for fabricating the xeroradiographic photoreceptor plates involves vacuum deposition of an amorphous selenium alloy layer having a thickness of about 150 micrometers onto an aluminum substrate at about 75° C. (167° F.). The deposited selenium alloy layer is usually free of crystalline selenium. These xeroradiographic plates require a moderate amount of X-ray dosage to expose the plates after they have been uniformly electrostatically charged. For selenium-arsenic alloys vacuum deposited onto a metallic substrate using a conventional vacuum coating apparatus, the exposed alloy surface area in the crucibles should be minimized in order to maximize evaporation rate thereby controlling arsenic fractionation to within acceptable limits. The maximum exposed alloy surface area varies with deposition conditions such as temperature, distance between crucible and substrate, etc., but can be determined experimentally, for example, by conducting multiple runs with a reduction of the exposed alloy surface area on each successive run until analysis of the top surface concentration of the deposited selenium alloy layer reveals a low arsenic concentration, e.g. less than about 2 percent by weight. The selenium alloy shot in the crucibles in the vacuum coater may be evaporated using a time/-temperature schedule designed to minimize the fractionation of the alloy during evaporation. Thus, the percentage of arsenic in the starting selenium alloy shot is substantially the same as the percentage of arsenic at the surface of the deposited alloy layer. Maintaining the arsenic concentration between about 0.3 percent and about 2 percent by weight and the chlorine concentration below about 20 parts per million at the surface of the selenium alloy layer facilitates both hole and electron transport for high X-ray sensitivity. This bipolar characteristic of the alloy layer means that two carriers, electrons and holes are free to move within the bulk of the alloy layer but may not necessarily be injected across the substrate or top surface interfaces. In a typical crucible evaporation program, the alloy layer is formed in about 20 to about 120 minutes during which time the crucible temperature is increased from about 221° C. (430° F.) to about 287° C. (550° F.) and the substrate is maintained at a temperature of between about 74° C. (165° F.) and about 80° C. (176° F.). Chamber pressure during evaporation is in the order of of less than about $8\times10^{-5}$ Torr. The amount of alloy present in the crucibles will depend upon the specific coater configuration and other process variables but will be calibrated to yield the desired thickness. Satisfactory results may be achieved with a selenium-arsenic alloy photoconductive alloy layer having between about 0.1 percent and about 2 percent by weight arsenic at the surface of the photoconductive insulating layer facing away from the conductive substrate and a thickness between about 100 micrometers and about 400 micrometers. Levels of arsenic exceeding about 2 percent can lead to reticulation, a catastrophic wrinkling of the surface of the photoconductive insulating layer facing away from the conductive substrate. Such wrinkling can render the imaging member unsuitable for applications which require highly detailed and precise images such as mammograms.

The deposited selenium-arsenic is annealed after coating at a temperature below the glass transition temperature of the alloy layer. Annealing is conducted at a temperature of between about 43° C. (109° F.) and about 49° C. (120° F.) for a period of between about 36 hours and about 54 hours.

Techniques for preparing electroradiographic imaging layers are well known and disclosed, for example, in U.S. Pat. No. 4,770,965 the disclosure of this patent being incorporated herein in its entirety.

The overcoating composition of this invention comprises a mixture of a polyester resin, a diamine charge transport molecule and nigrosine. The polyester component of the overcoating of this invention has the following formula:

$$\overset{O}{\overset{\|}{HOC}}\text{-[diacid-diol]}_n\text{-OH}$$

wherein the diacid is selected from the group consisting of terephthalic acid, isophthalic acid, and mixtures thereof, the diol is selected from the group consisting of ethylene glycol, 2,2-dimethyl propane and mixtures thereof, the ratio of diacid to diol is 1:1, n is a number between about 175 and about 350 and the $T_g$ of the copolyester resin is between about 50° C. about 80° C. Typical polyester resins having the above structure include, for example, Vitel PE-100, Vitel PE-200, Vitel PE-200D, and Vitel PE-222, all available from Goodyear Tire and Rubber Co.

One specific example of a polyester resin that may be employed in the overcoating layers of this invention is a copolyester available from Goodyear Tire & Rubber Co. as Vitel PE-100. This polyester resin is a linear saturated copolyester of two diacids and ethylene glycol. The molecular structure of this linear saturated copolyester is represented by the following:

$$\overset{O}{\overset{\|}{HOC}}\text{-[diacid-ethylene glycol]}_n\text{-OH}$$

where the ratio of diacid to ethylene glycol in the copolyester is 1:1. The diacids are terephthalic acid and isophthalic acid. The ratio of terephthalic acid to isophthalic acid is 3:2. The Vitel PE-100 linear saturated copolyester consists of alternating monomer units of ethylene glycol and two randomly sequenced diacids in the above indicated ratio and has a molecular weight of about 50,000 and a $T_g$ of about 71° C.

Another polyester resin that may be used in the overcoating layer of this invention is available from Goodyear Tire & Rubber Co. as Vitel PE-200. This polyester resin is a linear saturated copolyester of two diacids and two diols. The molecular structure of this linear saturated copolyester is represented by the following:

$$\overset{O}{\overset{\|}{HOC}}\text{-[Diacid-Diol]}_n\text{-OH}$$

where the ratio of diacid to ethylene glycol in the copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. The Goodyear PE-200 linear saturated copolyester consists of randomly alternating monomer units of the two diacids and the two diols in the above indicated ratio and has a molecular weight of about 45,000 and a $T_g$ of about 67° C.

The diacids from which the polyester resins used in the overcoating of this invention are derived are terephthalic and isophthalic acids only. The diols from which the polyester resins of this invention are derived include ethylene glycol. Other glycols such as 2,2-dimethyl propane diol may also be employed in combination with ethylene glycol to prepare the polyester resins for the overcoating of this invention.

Satisfactory results are achieved when the polyester resin is present in the overcoating in an amount between about 85 percent and about 97 percent by weight based on the total weight of solids. When the amount of polyester is less than about 85 percent, phase separation between the aromatic amine compound and polyester results in poor film quality. If the amount of polyester exceeds about 97 percent by weight, fatigue white spots appear. Preferably, the polyester resin is present in an amount between about 90 percent and about 95 percent by weight based on the total weight of solids. Optimum results may be achieved with about 92 percent by weight polyester resin based on the total weight of solids.

Any suitable aromatic amine compound charge transporting small molecule may be utilized in the overcoating of this invention. The aromatic amine compound charge transporting small molecule preferably comprises an aromatic amine compound having the general formula:

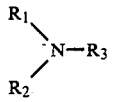

wherein $R_1$ and $R_2$ are an aromatic group independently selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

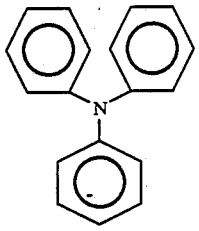

II. Bis and poly triarylamines such as:

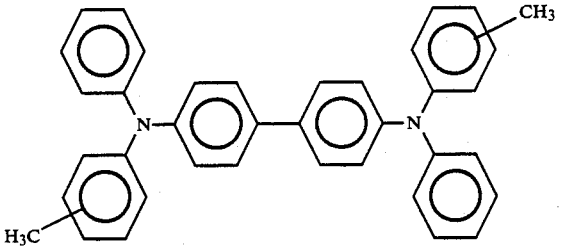

III. Bis arylamine ethers such as:

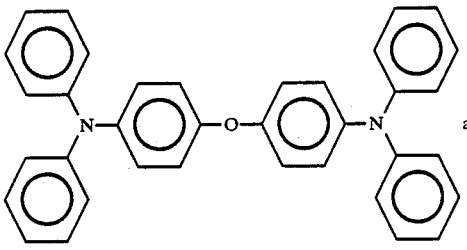

and

IV. Bis alkyl-arylamines such as:

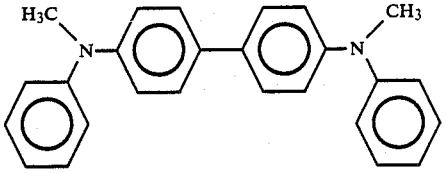

A preferred aromatic amine compound has the general formula:

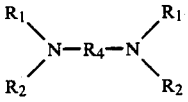

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Examples of charge transporting aromatic amines represented by the structural formulae above capable of supporting the injection of photogenerated holes and transporting the holes through the overcoating layer include triphenylmethane, bis(4-diethylamine-2-methylphenyl)phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like. Satisfactory results may be achieved with between about 3 percent and about 15 percent by weight diamine based on the total weight of the solids. When less about 3 percent by weight aromatic amine is employed, fatigue white spots appear. Concentrations of diamine greater than about 15 percent can result in phase separation and poor film quality. Optimum results may be achieved with about 7.5 percent by weight diamine based on the total weight of solids. Although, the above materials pertain to specific preferred charge transporting specie, aromatic amines, other suitable charge transporting compounds which are soluble or dispersible on a molecular scale in the copolyester binder may be utilized in the overcoating of this invention. The charge transport molecule should be capable of transporting charge carriers injected into the overcoating layer in an applied electric field. The charge transport molecules may be hole transport molecules. Charge transporting materials are well known in the art. A partial listing representative of typical charge transporting materials include the following:

Pyrazoline transport molecules as disclosed in U.S. Pat. Nos. 4,315,982, 4,278,746, 3,837,851. Typical pyrazoline transport molecules include 1-[lepidyl-(2)]-3-(p-diethylaminophenyl)-5-(p-diethylaminophenyl)-pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)-pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944.

Hydrazone transport molecules such as p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example in U.S. Pat. Nos. 4,385,106, 4,338,388, 4,387,147, 4,399,208, 4,399,207.

Carbazole phenyl hydrazone transport molecules such as 9-methylcarbazole-3-carbaldehyde-1,1-diphenylhydrazone,9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Tri-substituted methane transport molecules such as alkyl-bis(N,N-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989.

9-fluorenylidene methane derivative transport molecules such as 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other typical transport materials include the numerous transparent organic transport materials described in U.S. Pat. No. 3,870,516 and the nonionic compounds described in U.S. Pat. No. 4,346,157.

The disclosures of each of the patents identified above pertaining to charge transport molecules which are soluble or dispersible on a molecular scale in a film forming binder are incorporated herein by reference in their entirety. A charge transporting compound is a compound when added to an electrically inactive resinous material will make the electrically inactive resinous materials electrically active, i.e. capable of facile hole injection and transport.

When the charge transport molecules are combined with the copolyester film forming binder, the amount of charge transport molecule which is used may vary depending upon the particular charge transport material and its compatibility (e.g. solubility in the continuous insulating film forming binder phase of the overcoating layer) and the like. Satisfactory results have been obtained using the proportions normally used to form the charge transport medium of photoreceptors containing a charge transport component and a charge generating component. Proportions normally used to form the charge transport medium of photoreceptors containing a charge transport component and a charge generating component are described in the partial listing above.

The nigrosine component of the overcoating of this invention is in powder form and dissolved in the overcoat solution at ambient temperature. Satisfactory results are achieved when the nigrosine component is present in an amount between about 0.1 percent and about 2 percent based on the total weight of the solids. Optimum results are achieved when the nigrosine is present in an amount between 0.4 percent and about 1.5 percent based on the total weight of solids.

Generally, the overcoating is applied with the aid of a solvent. Any suitable solvent may be utilized. Typical solvents include, for example, cyclohexanone, tetrahydrofuran, methylene chloride, trichloroethane, dioxane, methyl ethyl ketone, and the like and mixtures thereof. The overcoat coating composition is prepared by dissolving all the components in the solvent. The amount of solvent employed depends upon the technique utilized for applying the coating. Thus, a larger proportion of solvent will be employed for spray applications and less solvent would be used for dip coating. Any suitable coating technique may be employed to apply the overcoating composition of this invention. Typical coating techniques include flow coating, spray coating, dip coating, extrusion coating, drawbar coating and the like.

Any suitable technique may be employed to dry the coating. Typical drying techniques include over drying, forced air drying, infrared radiation drying, and the like. Satisfactory results may be achieved when the dried overcoating has a thickness of between about 0.05 micrometer and about 2 micrometers. When the thickness falls below about 500 angstroms, protection against crystallization is not adequate and abrasion life is low. Overcoating thicknesses exceeding about 2 micrometers can result in ghosting and background increase resulting from the residual voltage across the overcoat. Preferably, the thickness of the dried overcoating is between about 0.1 micrometer and about 0.5 micrometer.

The electrophotographic imaging member of this invention may be employed in conventional cyclic xeroradiographic imaging processes involving repeated uniform charging, image exposure, development, transfer, erasure and cleaning cycles. Any suitable development technique may be utilized to develop the electrostatic latent image on the electroradiographic imaging member of this invention. A well known electroradiographic development technique is powder cloud development. Powder cloud development is preferred because it is capable of developing 30 line pairs per millimeter whereas many other techniques such as two component development techniques are capable of developing only about 6 line pairs per millimeter. Generally, the average size of powder cloud toner particles is between about 1 micrometer and about 10 micrometer. The deposited toner image may be transferred to a receiving member by any suitable conventional transfer technique, e.g. electrostatic, tape and the like, and affixed to the receiving member by any suitable well known fixing technique. Cleaning of the xeroradiographic imaging member to remove any residual toner particles remaining after transfer may be effected by any suitable conventional cleaning technique such as brush cleaning, blade cleaning, web cleaning, moistened foam roll cleaning and the like. Erasure of the electrostatic latent image may also be accomplished by any suitable conventional technique. Typical conventional erase techniques include AC corona discharge, negative corona discharge, illumination from a light source, contact with a grounded conductive brush, thermal relaxation and combinations thereof.

The overcoating of this invention reduces the number of rejected plates due to white spots at time equals zero (t=0). The overcoating of this invention also produces sharper images as perceived by physicians. Moreover, the overcoating of this invention is RH insensitive. Further, the overcoating of this invention increases the life of a xeroradiographic plate and, therefore, the number of images that may be produced. For example, the average number of images achievable with plate of this invention is greater than about 200 compared to about 150 for a popular commercial prior art plate.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

An electrophotographic imaging member was prepared by evaporating halogen doped selenium-arsenic alloy shot onto a flat aluminum substrate having the dimensions 23 cm (9¼ in)×36 cm (14¼ in)×2 mm (0.080 in). The aluminum substrate carried on its outer surface a thin layer of aluminum oxide having a thickness between about 20 Angstroms and about 200 Angstroms. The aluminum substrate was cleaned prior to vacuum coating. The cleaned aluminum substrate was then exposed to a glow discharge cleaning and oxide formation step within a vacuum coater at an initial pressure of about $3.8\times10^{-2}$ millimeters of mercury while air was air bled into the coater and the substrate temperature was raised by the glow discharge treatment to about 85° C. (185° F.) to provide a smooth etched aluminum oxide coated photoreceptor layer receiving surface on the substrate. The short edges of the substrate were masked to prevent selenium alloy deposition. Halogen doped selenium-arsenic alloy shot contained about 0.35 percent by weight arsenic, about 11.5 parts per million by weight chlorine, and the remainder selenium, based on the total weight of the alloy was placed in crucibles in a vacuum coater and evaporated from chrome coated stainless steel crucibles at an evaporation temperature which increased from about 21° C. (70° F.) to about 252° C. (485° F.) and then decreased to about 21° C. (70° F.) while the evaporation pressure was maintained between about $5\times10^{-4}$ torr and $1\times10^{-5}$ torr. The substrate temperature was maintained at about 82° C. (180° F.) during this evaporation coating operation. The resulting halogen doped selenium-arsenic layer after a deposition period of about 45 minutes and a gradual cool down period of about 35 minutes had a thickness of about 140 micrometers and contained about 0.33 percent by weight arsenic, about 10 parts per million by weight chlorine and the remainder selenium. The halogen doped selenium-arsenic layer on each substrate was thereafter coated with an overcoating mixture.

An overcoating solution was prepared by dissolving about 110.4 gm polyester resin (Vitel PE200, available from Goodyear Goodyear Tire & Rubber Company), about 34.5 gm polyurethane resin (Vithane TPU123, available from Goodyear Goodyear Tire & Rubber Company), about 69 gm polyvinylidene chloride resin (Saran F310, available from Dow Chemical Company) and 1.074 gm nigrosene (Z-1630 available from American Cyanamid Company) in 14,360 ml of cyclohexanone. After filtering, the coating solution was applied to the selenium alloy layer by flow coating during which the imaging surface was maintained in a vertical orientation. The coating solution was poured from an applicator bottle along the left vertical edge of the plate surface moving from bottom to top and continued along the top edge of the long dimension of the plate and down the right side. Without breaking the flow, application was continued back up the right side and across the center of the plate to ensure that the overcoating solution completely and uniformly covered the plate surface. After drying, additional coating solution was applied in the same manner as the previous coating. Upon further drying, the bottom of the plate was wiped with a clean room cloth and the plate was turned over 180 degrees. The two coating and drying steps described above were then repeated. The dried overcoating had a thickness of about 0.1 micrometer.

EXAMPLE II

The xeroradiographic imaging member prepared as described in Example I was placed in a Xerox 125/126 xeroradiography machine and subjected to rapid xeroradiographic cycling (1–6 images per hour). The xeroradiographic imaging member was developed by powder cloud development. Examination of the images transferred to paper revealed numerous print spot deletions (white spots) due to xeroradiographic imaging member fatigue. These white spots had an average size at least as large as 0.005 inch and were visible to the naked eye. The white spots were observed to vary in concentration from 50 to >350 spots per square inch across the plate and were often concentrated along the leading edge into development.

EXAMPLE III

The xeroradiographic imaging member prepared as described in Example II was completely stripped of its overcoating by thoroughly flushing the surface of the overcoated member with clean cyclohexanone.

An overcoating solution was prepared by dissolving about 107 gm polyester resin (Vitel PE200, available from Goodyear Goodyear Tire & Rubber Company), about 0.537 gm nigrosene (Z-1630 available from American Cyanamid Company) and about 8 gm N,N'-diphenyl-N,N'-bis(3-methylphenyl)-[1,1'-biphenyl]-4,4'-diamine in 9,940 ml of cyclohexanone. After filtering, the coating solution was applied to the selenium alloy layer by flow coating during which the imaging surface was maintained in a vertical orientation. The coating solution was poured from an applicator bottle along the left vertical edge of the plate surface moving from bottom to top and continued along the top edge of the long dimension of the plate and down the right side. Without breaking the flow, application was continued back up the right side and across the center of the plate to ensure that the overcoating solution completely and uniformly covered the plate surface. After drying, additional coating solution was applied in the same manner as the previous coating. Upon further drying, the bottom of the plate was wiped with a clean room cloth and the plate was turned over 180 degrees. The two coating and drying steps described above were then repeated. The dried overcoating had a thickness of about 0.3 micrometer.

EXAMPLE IV

The xeroradiographic imaging member prepared as described in Example II was placed in a Xerox 125/126 xeroradiography machine and subjected to rapid xeroradiographic cycling (1–6 images per hour). The xeroradiographic imaging member was developed by powder cloud development. Examination of the images transferred to paper revealed no fatigue print spot deletions, i.e. no white spots having an average size at least as large as 0.005 inch in concentrations of >2 spots per square inch were visible to the naked eye. This test demonstrates that the overcoating of this invention xeroradiographic imaging member prevents fatigue and performs significantly better than the prior art overcoatings of Examples I and II.

EXAMPLE V

A batch of 48 selenium alloy plates were manufactured as described in Example I, but overcoated using the materials and procedures described in Example III. 70 percent of these plates were found to be acceptable. The 14 rejected plates were found to be unacceptable because of various defects such as powder deficient spots caused by the presence of contaminants. Neither the unacceptable plates nor the acceptable plates had any white spots having an average size at least as large as 0.005 inch in concentrations of >5 spots per square inch visible to the naked eye. The acceptable plates from this batch are hereinafter referred to as "A" plates.

Another batch of 48 selenium alloy plates were manufactured and overcoated with the overcoat as described in Example I. Only 20 percent of the overcoated plates were found to be acceptable. About 14 of the 38 rejected plates were found to be unacceptable because of various defects such as powder deficient spots caused by the presence of contaminants. The other 24 unacceptable plates had white spots having an average size at least as large as 0.005 inch in concentrations of >5 spots per square inch visible to the naked eye. The acceptable plates had no defects such as white spots having an average size at least as large as 0.005 inch in concentrations of >5 spots per square inch visible to the naked eye. The acceptable plates from this batch are hereinafter referred to as "B" plates.

EXAMPLE VI

When xeroradiographic images were prepared in carefully monitored and maintained radiographic machines with the acceptable "B" plates of Example V, less than 100 images could be made before fatigue white spots set in to render the B plates unacceptable. When xeroradiographic images were prepared in carefully monitored and maintained radiographic machines with the acceptable "A" plates of Example V, greater than 250 images were produced without fatigue white spots setting in. Success or failure of the plates was determined in a controlled clinical test environment at a physician's office. Acceptance and rejection of the plates was based on print quality which in turn was based on white spot counts per plate and also on the perceived satisfaction of a physician viewing the prints.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A xeroradiographic imaging member comprising a substrate having an electrically conductive surface, an electroradiographic insulating layer selected from the group consisting of selenium and selenium alloys, and an overcoating layer comprising nigrosene, a charge transport compound and a copolyester resin represented by the following formula:

$$\overset{O}{\overset{\|}{HOC}}\text{-[diacid-diol]}_n\text{-OH}$$

wherein said diacid is selected from the group consisting of terephthalic acid, isophthalic acid, and mixtures thereof, said diol comprises ethylene glycol, the mole ratio of said diacid to said diol is about 1:1, n is a number between about 175 and about 350 and the $T_g$ of said copolyester resin is between about 50° C. about 80° C.

2. A xeroradiographic imaging member according to claim 1 wherein said overcoating layer having a thickness between about 0.05 micrometer and about 2 micrometers.

3. A xeroradiographic imaging member according to claim 1 wherein said overcoating layer has a dry thickness of between about 0.1 micrometer and about 0.5 micrometer.

4. A xeroradiographic imaging member according to claim 1 wherein said overcoating layer comprises between about 85 percent and about 97 percent by weight of said copolyester resin based on the total weight of solids.

5. A xeroradiographic imaging member according to claim 1 wherein said overcoating layer comprises between about 90 percent and about 95 percent by weight of said copolyester resin based on the total weight of solids.

6. A xeroradiographic imaging member according to claim 1 wherein said overcoating layer comprises between about 0.1 percent and about 2 percent of said nigrosene based on the total weight of solids.

7. A xeroradiographic imaging member according to claim 1 wherein electroradiographic insulating layer comprises a selenium alloy vacuum deposited from a starting alloy doped with between about 5 and about 25 parts per million by weight chlorine.

8. A xeroradiographic imaging member according to claim 1 wherein electroradiographic insulating layer comprises a selenium alloy vacuum deposited from a starting alloy comprising between about 0.05 percent by weight and about 2 percent by weight arsenic based on the total weight of said starting alloy.

9. A xeroradiographic imaging member according to claim 1 wherein electroradiographic insulating layer comprises a selenium alloy vacuum deposited from a starting alloy comprising between about 0.2 percent by weight and about 0.5 percent by weight arsenic based on the total weight of said starting alloy.

10. A xeroradiographic imaging member according to claim 1 wherein said alloy layer has a thickness between about 60 micrometers and about 500 micrometers.

11. A xeroradiographic imaging member according to claim 1 wherein said alloy layer has a thickness between about 100 micrometers and about 400 micrometers.

12. A xeroradiographic imaging member according to claim 1 wherein said alloy layer has a thickness between about 150 micrometers and about 300 micrometers.

13. A xeroradiographic imaging member comprising a substrate having an electrically conductive surface, an electroradiographic insulating layer selected from the group consisting of selenium and selenium alloys, and an overcoating layer consisting essentially of nigrosene, a charge transport aromatic amine compound represented by the following formula:

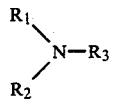

wherein $R_1$ and $R_2$ are an aromatic group independently selected from the group consisting of a substituted or unsubstituted phenyl group, naphthyl group, and polyphenyl groups and $R_3$ is selected from the group consisting of a substituted or unsubstituted aryl group, alkyl group having from 1 to 18 carbon atoms and cycloaliphatic compounds having from 3 to 18 carbon atoms and a copolyester resin represented by the following formula:

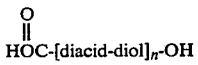

wherein said diacid is selected from the group consisting of terephthalic acid, isophthalic acid, and mixtures thereof, said diol comprises ethylene glycol, the mole ratio of said diacid to said diol is about 1:1, n is a number between about 175 and about 350 and the $T_g$ of said copolyester resin is between about 50° C. about 80° C.

14. A xeroradiographic imaging member according to claim 13 wherein said aromatic amine is a compound represented by the following formula:

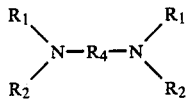

wherein $R_1$ and $R_2$ are an aromatic group independently selected from the group consisting of a substituted or unsubstituted phenyl group, naphthyl group, and polyphenyl groups and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms.

15. A xeroradiographic imaging member according to claim 13 wherein said aromatic amine is N,N'-diphenyl-N,N'-bis(3-methylphenyl)-(1,1'-biphenyl)-4,4'-diamine.

16. A xeroradiographic imaging member according to claim 13 wherein said overcoating layer comprises between about 3 percent and about 15 percent by weight of said aromatic amine based on the total weight of solids.

17. A xeroradiographic imaging process comprising providing a xeroradiographic imaging member comprising a xeroradiographic imaging member comprising a substrate having an electrically conductive surface, an electroradiographic insulating layer selected from the group consisting of selenium and selenium alloys, and an overcoating layer comprising nigrosene, a charge transport compound and a copolyester resin represented by the following formula:

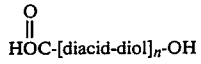

wherein said diacid is selected from the group consisting of terephthalic acid, isophthalic acid, and mixtures thereof, said diol comprises ethylene glycol, the mole ratio of said diacid to said diol is about 1:1, n is a number between about 175 and about 350 and the $T_g$ of said copolyester resin is between about 50° C. about 80° C., depositing a uniform electrostatic charge on said overcoating of said imaging member, exposing said member to X-ray radiation in image configuration to form an electrostatic latent image on said overcoating, developing said electrostatic latent image with finely divided toner particles applied as a powder cloud to form a toner image corresponding to said electrostatic latent image, and transferring said toner image to a receiving member.

18. A xeroradiographic imaging process according to claim 17 wherein said charge transport compound is an aromatic amine compound represented by the following formula:

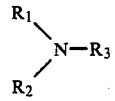

wherein $R_1$ and $R_2$ are an aromatic group independently selected from the group consisting of a substituted or unsubstituted phenyl group, naphthyl group, and polyphenyl groups and $R_3$ is selected from the group consisting of a substituted or unsubstituted aryl group, alkyl group having from 1 to 18 carbon atoms and cycloaliphatic compounds having from 3 to 18 carbon atoms.

19. A xeroradiographic imaging process according to claim 17 including repeating said depositing exposing, developing, and transfering steps at least once.

* * * * *